US007572164B2

(12) United States Patent
Takeda et al.

(10) Patent No.: US 7,572,164 B2
(45) Date of Patent: Aug. 11, 2009

(54) METHOD FOR MANUFACTURING ELECTRON-EMITTING DEVICE, METHODS FOR MANUFACTURING ELECTRON SOURCE AND IMAGE DISPLAY DEVICE USING THE ELECTRON-EMITTING DEVICE

(75) Inventors: Toshihiko Takeda, Kanagawa-ken (JP); Koki Nukanobu, Kanagawa-ken (JP); Takuto Moriguchi, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 675 days.

(21) Appl. No.: 11/150,189

(22) Filed: Jun. 13, 2005

(65) Prior Publication Data

US 2005/0282458 A1 Dec. 22, 2005

(30) Foreign Application Priority Data

Jun. 17, 2004 (JP) ..... 2004-179929

(51) Int. Cl.
*H01J 9/00* (2006.01)
*H01J 9/12* (2006.01)

(52) U.S. Cl. ..... 445/46; 445/50; 445/51

(58) Field of Classification Search ..... 445/46–50, 445/24–25; 313/495–497
See application file for complete search history.

(56) References Cited

U.S. PATENT DOCUMENTS

| | | | | |
|---|---|---|---|---|
| 4,904,895 | A | 2/1990 | Tsukamoto et al. | 313/336 |
| 5,066,883 | A | 11/1991 | Yoshioka et al. | 313/309 |
| 5,532,544 | A | 7/1996 | Yoshioka et al. | 313/310 |
| 5,605,483 | A | 2/1997 | Takeda et al. | 445/2 |
| 5,661,362 | A | 8/1997 | Yoshioka et al. | 313/309 |
| 5,749,763 | A | 5/1998 | Yoshioka et al. | 445/51 |
| 5,759,080 | A | 6/1998 | Yoshioka et al. | 445/51 |
| 5,786,658 | A | 7/1998 | Tsukamoto et al. | 313/309 |
| 5,872,541 | A | 2/1999 | Yoshioka et al. | 345/74 |
| 5,973,449 | A * | 10/1999 | Nakamura et al. | 313/461 |
| 5,986,389 | A | 11/1999 | Tsukamoto | 313/310 |
| 6,008,569 | A | 12/1999 | Yamanobe | 313/310 |
| 6,091,190 | A * | 7/2000 | Chalamala et al. | 313/346 R |
| 6,147,449 | A | 11/2000 | Iwasaki et al. | 313/495 |
| 6,184,610 | B1 | 2/2001 | Shibata et al. | 313/309 |
| 6,267,636 | B1 | 7/2001 | Onishi et al. | 445/6 |
| 6,313,815 | B1 | 11/2001 | Takeda et al. | 345/75.2 |
| 6,348,761 | B1 | 2/2002 | Nomura et al. | 313/495 |
| 6,379,211 | B2 | 4/2002 | Onishi et al. | 445/73 |
| 6,459,207 | B1 | 10/2002 | Nomura et al. | 315/169.3 |

(Continued)

FOREIGN PATENT DOCUMENTS

JP 8-102247 4/1996

(Continued)

OTHER PUBLICATIONS

Hausmann et al., *Atomic Layer Deposition of Hafnium and Zirconium Oxides Using Metal Amide Precursors*, Chem. Mater. vol. 14, No. 10, 2002, pp. 4350-4358.

*Primary Examiner*—Nimeshkumar D. Patel
*Assistant Examiner*—Anne M Hines
(74) *Attorney, Agent, or Firm*—Fitzpatrick, Cella, Harper & Scinto

(57) ABSTRACT

A method for manufacturing a precursor to an electron-emitting device includes the steps of preparing an electron-emitting member, and alternately exposing the electron-emitting member to an oxygen-containing gas and a metal-containing gas.

19 Claims, 8 Drawing Sheets

U.S. PATENT DOCUMENTS

| | | | | |
|---|---|---|---|---|
| 6,473,063 | B1 | 10/2002 | Suzuki et al. | 345/74.1 |
| 6,515,640 | B2 | 2/2003 | Tsukamoto et al. | 345/75.2 |
| 6,555,957 | B1 | 4/2003 | Nomura et al. | 313/495 |
| 6,726,520 | B2 | 4/2004 | Takeda et al. | 445/62 |
| 6,760,002 | B2 | 7/2004 | Suzuki et al. | 345/74.1 |
| 6,835,110 | B2 | 12/2004 | Mizuno et al. | 445/6 |
| 6,896,571 | B2 | 5/2005 | Mizuno et al. | 445/24 |
| 6,900,581 | B2 | 5/2005 | Kyogaku et al. | 313/310 |
| 7,021,981 | B2 | 4/2006 | Onishi et al. | 445/6 |
| 7,067,336 | B1 | 6/2006 | Kyogaku et al. | 438/20 |
| 7,077,716 | B2 | 7/2006 | Mizuno et al. | 445/24 |
| 2001/0054865 | A1 | 12/2001 | Danjo et al. | 313/495 |
| 2003/0042147 | A1* | 3/2003 | Talin et al. | 205/238 |
| 2003/0161942 | A1 | 8/2003 | Arai et al. | 427/77 |
| 2003/0165615 | A1 | 9/2003 | Aaltonen et al. | 427/79 |
| 2005/0225230 | A1 | 10/2005 | Takeda et al. | 313/496 |
| 2005/0236952 | A1 | 10/2005 | Moriguchi et al. | 313/310 |
| 2005/0258734 | A1 | 11/2005 | Nukanobu et al. | 313/495 |

FOREIGN PATENT DOCUMENTS

| | | |
|---|---|---|
| JP | 8-273523 | 10/1996 |
| JP | 9-102267 | 4/1997 |
| JP | 9-167584 | 6/1997 |
| JP | 9-330648 | 12/1997 |
| JP | 10-188778 | 7/1998 |
| JP | 2003-226970 | 8/2003 |
| JP | 2004-47634 | 2/2004 |
| JP | 2004-158470 | 6/2004 |

* cited by examiner

METHOD FOR MANUFACTURING ELECTRON-EMITTING DEVICE, METHODS FOR MANUFACTURING ELECTRON SOURCE AND IMAGE DISPLAY DEVICE USING THE ELECTRON-EMITTING DEVICE

BACKGROUND OF THE INVENTION

1. Field of the Invention

The present invention relates to a method for manufacturing an electron-emitting device, and to a method for manufacturing an electron source and an image display device using the electron-emitting device. The present invention also relates to an information displaying/reproducing apparatus using the image display device.

2. Description of the Related Art

An electron-emitting device may be classified into a field emission type or a surface conduction type.

There is a case in which a surface of the electron-emitting device is coated with a metal film or a metal compound film to reduce the effective work function, increase the heat resistance (heat-proof), or stabilize the emission current, as disclosed in Japanese Patent Laid-Open Nos. 10-188778, 8-102247, 8-273523, and 9-102267. A plurality of the electron-emitting devices are arranged to define an electron source. The electron source is disposed so as to oppose an anode electrode and a light-emitting member such as a phosphor, thus constituting a flat panel display and other image display devices.

SUMMARY OF THE INVENTION

In order to achieve brighter images stably, it is desired to stabilize the electron emission characteristics and to increase the electron emission efficiency of electron-emitting devices.

The electron emission efficiency mentioned herein is defined as the ratio of device current $I_f$ to emission current $I_e$. When a voltage is applied between an electrode (cathode electrode) electrically connected to an electron-emitting member and an electrode (gate electrode or extraction electrode) for applying a potential for extracting electrons from the electron-emitting member, the device current $I_f$ flows between both electrodes and the emission current $I_e$ flows between cathode electrode and the anode electrode. It is desired that while the device current $I_f$ is low, the emission current $I_e$ is high.

A low power consumption high-quality image forming device, such as a low power consumption high-definition flat television, can be realized by stably controlling the electron emission characteristics, and by enhancing the electron emission efficiency. In addition, as device current $I_f$ is reduced, the costs of the components of the image forming device, such as a drive circuit, can be reduced.

Conventional electron-emitting devices, however, do not necessarily exhibit satisfactory stable electron emission characteristics or satisfactory electron emission efficiency. Also, the image display device using the conventional electron-emitting device cannot necessarily operate stably. Accordingly, an electron-emitting device is desired which can maintain its superior electron emission characteristics for a long time.

The above-described technique for coating the surface of the electron-emitting device with a film is intended to stabilize the electron emission characteristics and increase the electron emission efficiency. However, the technique has not yet been used in practical application, because the electron emission characteristics of the electron-emitting device are extremely sensitive to the physical properties and shape of the surface of the electron-emitting portion and, accordingly, the composition and thickness of the coating film need to be strictly controlled.

In particular, an image display device in which an electron source exhibiting uniform characteristics is disposed over a large area requires highly sophisticated manufacturing techniques. Accordingly, a highly controllable simple method is desired in manufacture.

In view of the above-described disadvantages, the present invention provides simple methods for manufacturing an electron-emitting device exhibiting superior characteristics and an image display device including such electron-emitting devices.

The inventors of the present invention have conducted intensive research to overcome the above-described disadvantages, and consequently have found that a highly controlled metal or metal compound coating film can be formed over the surface of an electron-emitting device (electron-emitting member) by alternately applying a metal-containing gas and an oxygen-containing gas.

According to a first aspect of the present invention, a method for manufacturing a precursor to an electron-emitting device is provided which includes the steps of preparing an electron-emitting member, and alternately exposing the electron-emitting member to an oxygen-containing gas and a metal-containing gas.

The metal-containing gas can be an organic metal. The oxygen-containing gas can be $O_2$ or $H_2O$. The electron-emitting member may contain carbon. The electron-emitting member may be made of carbon fibers. The oxygen-containing gas can have a partial pressure in the range of $1\times10^{-4}$ to $1\times10^{4}$ Pa. The metal-containing gas can have a partial pressure in the range of 1 to 1000 Pa. The electron-emitting member can be formed by applying a current between a first electroconductive film and a second electroconductive film in an atmosphere containing a carbon-containing gas.

According to another aspect of the present invention, a method for manufacturing a precursor to an electron-emitting device is provided which includes the step of preparing a first electroconductive film and a second electroconductive film, and alternately exposing at least one of the first electroconductive film and the second electroconductive film to an oxygen-containing gas and a metal-containing gas.

The step of preparing the first electroconductive film and the second electroconductive film may include the sub steps of forming an electroconductive film on a substrate, flowing a current through the electroconductive film to form a gap in the electroconductive film, and flowing a current through the electroconductive film having the gap in an atmosphere containing a carbon-containing gas. The metal-containing gas may be an organic metal. The oxygen-containing gas may be $O_2$ or $H_2O$. The oxygen-containing gas can have a partial pressure in the range of $1\times10^{-4}$ to $1\times10^{4}$ Pa. The metal-containing gas can have a partial pressure in the range of 1 to 1000 Pa.

The metal-containing gas may contain a metal selected from the group consisting of hafnium, titanium, and zirconium.

According to another aspect, the present invention is directed to a method for manufacturing an electron source including a plurality of electron-emitting devices, and a method for manufacturing an image display device including the electron source and a light-emitting member. In these methods, the electron-emitting devices are produced using any of the foregoing methods for manufacturing such devices, including their precursors.

According to another aspect of the present invention, an information displaying/reproducing apparatus is provided which includes a receiver for outputting at least one type of information from among video information, character information, and sound information contained in received broadcast signals, and an image display device connected to the receiver. The image display device is produced by the foregoing method.

According to the method of the present invention, the surface of the electron-emitting device can be coated with a highly controlled coating film made of various types of materials. Thus, the electron emission characteristics can be stabilized and the electron emission efficiency can be enhanced, by a simple process.

Further features and advantages of the present invention will become apparent from the following description of exemplary embodiments with reference to the attached drawings.

DESCRIPTION OF THE EMBODIMENTS

Figure 1:
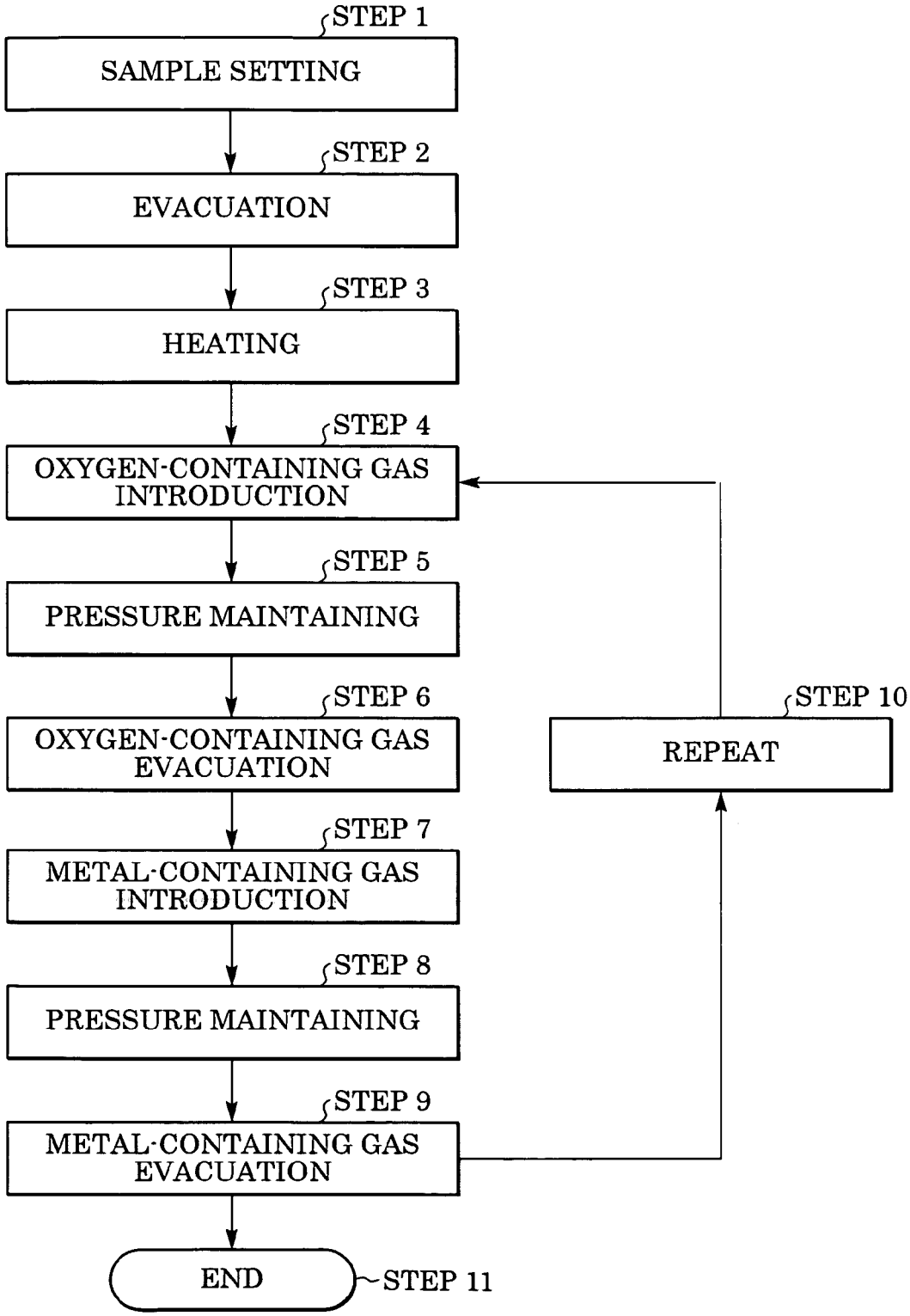
FIG. 1 is a flow diagram of a process for manufacturing an electron-emitting device according to the present invention.

The present invention will be further illustrated in detail with reference to the drawings FIG. 1 shows an example of a flow diagram representing a manufacturing method according to the present invention. The method will now be described with reference to FIG. 1.

Step 1: An electron-emitting device (sample) having an electron-emitting member (or electron-emitting portion) is placed in a vacuum apparatus (typically a vacuum chamber) (not shown in FIG. 1).

Step 2: The vacuum apparatus is evacuated. Specifically, it is preferable that the apparatus is evacuated to a pressure of $1\times10^{-4}$ Pa or less.

Step 3: The sample is heated to a desired temperature and maintained at the temperature.

The heating temperature is preferably set in the range of 50 to 500° C. By performing the following Steps 4 to 10 while the sample is heated at a temperature in this range, the speed of film coating can be increased. If the heating temperature is outside this range, the coating speed rapidly decreases, disadvantageously. More preferably, the heating temperature can be maintained in the range of 80 to 300° C.

Step 4: An oxygen-containing gas (water, oxygen, ozone, etc.) is introduced into the vacuum apparatus until the internal pressure is increased to a desired level. In general, the pressure of the oxygen-containing gas in the apparatus can be set in the range of $1\times10^{-4}$ to $1\times10^{4}$ Pa.

Step 5: The pressure is maintained for a predetermined time. This time depends on the pressure, but can generally be set between several seconds and several tens of seconds.

Step 6: The apparatus is evacuated to a background pressure.

Step 7: A metal-containing gas or material gas is introduced into the apparatus until the internal pressure is increased to a desired level.

In general, the pressure can be set in the range of $1\times10^{-4}$ to $1\times10^{3}$ Pa.

Step 8: The pressure is maintained for a predetermined time.

This time depends on the pressure, but can generally be set from 1 second to 100 seconds.

Step 9: The apparatus is evacuated to a background pressure.

Step 10: The sequence from step 4 to step 9 can be repeated a plurality of cycles. An atomic layer of a desired metal compound coating film is formed by one cycle of the sequence. By repeating the sequence a plurality of times, a coating film with a desired thickness can be formed with high precision. In the present invention, however, the sequence need be performed only once.

Step 11: Finally, after terminating the evacuation in Step 9, or after starting the evacuation in Step 9, the heating started in Step 3 is stopped to cool the sample gradually. When the sample temperature reaches almost room temperature, the electron-emitting device is taken out of the vacuum apparatus to complete the formation of the coating film.

In this process, evacuation can be performed with a generally used (conventional) turbopump, and heating can be performed with a heater. Evacuation when the material gas is introduced may be simply performed with a roughing vacuum pump, depending on the pressure.

The method of the present invention facilitates the formation of a desired metal or metal compound coating film on the surface of the electron-emitting device (or electron-emitting member) or on the surfaces of a plurality of electron-emitting devices that define an electron source. By using a low work function metal containing gas as the metal-containing gas, the work function at the surface of the resulting electron-emitting device can be reduced. By using a gas containing a metal having a high melting point as the metal-containing gas, the melting point of the surface of the electron-emitting device can be increased.

The inventors believe that one possible way in which the coating film is formed is through oxygen or hydroxyl groups becoming bound to the surface of the electron-emitting device (or electron-emitting member) by supplying water ($H_2O$), oxygen ($O_2$), ozone ($O_3$), or other oxidizing gas, and thus the surface is covered with oxygen (O—) or hydroxyl groups (OH—). Then, the oxygen or hydroxyl groups are reacted with the metal contained in the subsequently supplied metal-containing gas at the surface of the electron-emitting device, thereby forming a metal compound layer on the surface of the electron-emitting device.

This reaction is not completed until each gas supplied in this process reacts with all the reaction sites at the surface of the electron-emitting device, and, probably, remaining excessive gas does not react with the surface. By alternately supplying the oxygen-containing gas and the metal-containing gas, a desired metal compound layer can be formed or deposited at a thickness on the order of an atomic layer on the surface of the electron-emitting device. Accordingly, the thickness of the coating film is substantially controlled by the number of times of alternate gas supply. Thus, the thickness of the coating film can be controlled on the order of an atomic layer. Consequently, the present invention can achieve an electron-emitting device exhibiting superior electron emission characteristics and can realize a highly reproducible method for producing such an electron-emitting device.

Furthermore, since the method of the present invention supplies the material in a gas state, a uniform coating film may be formed even on a fine electron-emitting portion. Thus, electron-emitting portions of the electron-emitting devices having intricate shapes, such as microscopic steps and curvatures, can be covered with the coating film.

It is preferable that the metal-containing gas has a high vapor pressure at low temperatures or room temperature, from the viewpoint of facilitating the alternate reaction at the surface of the electron-emitting device and preventing excessive gases. Specifically, an organic metal gas used for MOCVD is preferably used.

Electron-emitting devices to which the method of the present invention can be applied include MIM type electron-emitting devices; field emission type electron-emitting device (e.g., so-called Spindt type filed emission electron-emitting devices) including a cone-shaped or pyramid-shaped electron-emitting member made by finely processing a metal or a semiconductor; field emission type electron-emitting devices including carbon fibers (having a diameter of 1 nm or more to less than 1 μm, preferably 1 to 500 nm), such as carbon nanotubes and graphite nanofibers, described below; and other cold cathode emission type electron-emitting devices, such as surface conduction type electron-emitting devices.

The method of the present invention is performed using an easily diffusible gas and also may control the thickness of the coating film on the order of an atomic layer. The method of the present invention can therefore be applied to an electron source having a plurality of electron-emitting devices arranged over a large area and an image display device including such an electron source.

An embodiment of the present invention will now be described which is applied to a surface conduction type electron-emitting device, in which the coating film formed by the method of the present invention can produce remarkable effects.

Figure 2A:
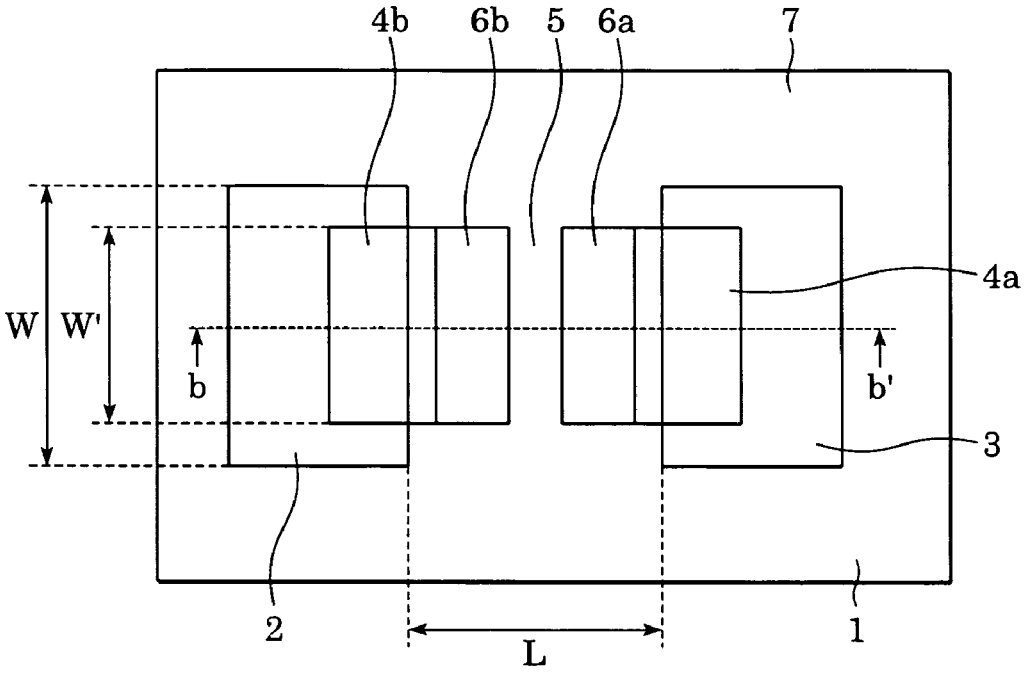
FIG. 2A is a schematic plan view of an electron-emitting device to which the present invention can be applied.
Figure 2B:
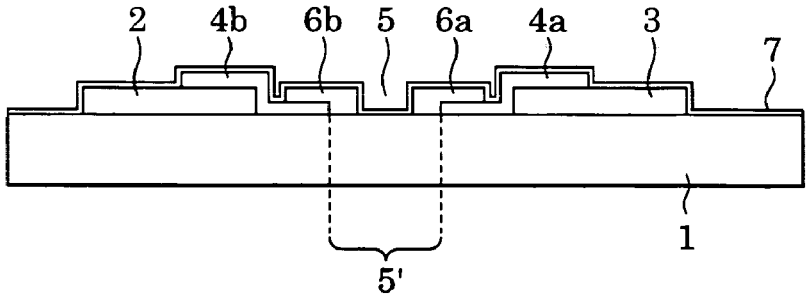
FIG. 2B is a cross sectional view of the electron-emitting device.

FIGS. 2A and 2B schematically show a surface conduction type electron-emitting device produced in a process using the method of the present invention. FIG. 2A is a schematic plan view and FIG. 2B is a schematic sectional view taken along line b-b' in FIG. 2A. Numeral 1 denotes a substrate 1, numeral 2 denotes a first electrode, numeral 3 denotes a second electrode, numeral 4*a* denotes a first auxiliary electrode, numeral 4*b* denotes a second auxiliary electrode, numeral 5 denotes a first gap, numeral 5' denotes a second gap, numeral 6*a* denotes a first electroconductive film, numeral 6*b* denotes a second electroconductive film, and numeral 7 denotes a metal or metal compound coating film formed by the method according to the present invention. The electroconductive films 6*a* and 6*b* are preferably composed of carbon films. In FIGS. 2A and 2B, the coating film 7 covers the entire surface of the substrate 1 (for convenience, other elements of FIG. 2A are not shown as being covered with the film 7, although they may be so covered, depending on the embodiment employed). These figures however schematically show the structure for easy understanding, and the coating film does not necessarily spread continuously over the entire surface of substrate 1 or over the whole device. Although the figures schematically show that the coating film 7 connects the first electroconductive film 6*a* to the second electroconductive film 6*b*, the first electroconductive film 6*a* need not necessarily be connected to the second electroconductive film 6*b* through the coating film 7 and, as pointed out above, the film 7 need not cover the whole device. In the present invention, it suffices that the metal or metal compound coating film 7 is provided over the surface of at least an electron-emitting portion of the electron-emitting member. In the electron-emitting device in this embodiment, at least one of the first and second electroconductive films 6*a* and 6*b* to which a lower voltage is applied for driving (when electrons are emitted) serves as the electron-emitting member.

The first and second auxiliary electrodes 4*a* and 4*b* are intended to facilitate the "activation" process, described later, and to reduce the "activation" process time. The auxiliary electrodes 4*a* and 4*b* may be distinct structural elements, from those of the first and second electrodes 2 and 3, as shown in FIGS. 2A and 2B. Alternatively, the auxiliary electrodes 4*a* and 4*b* may be omitted and the electrodes 2 and 3 may double (function) as the auxiliary electrodes; in other embodiments, the auxiliary electrodes 4*a* and 4*b* may be considered to be parts of the electrodes 2 and 3, respectively.

Since the electrodes 2 and 3 are intended to ensure the supply of voltage to the first and second electroconductive films 6*a* and 6*b*, the surface conduction type electron-emitting device shown in FIGS. 2A and 2B includes at least the first electroconductive film 6*a* and the second electroconductive film 6*b*. The first electroconductive film 6*a* and the second electroconductive film 6*b* are disposed with a distance of 50 nm or less, and preferably 3 to 10 nm. The distance may correspond to a width of the gap 5.

Although the first auxiliary electrode 4*a* is shown as being completely separate from the second auxiliary electrode 4*b* in FIGS. 2A and 2B, they may not be completely separate, depending on how they are formed, and they may be connected (e.g., at a tiny area), as long as not significantly affecting the electron emission characteristics. Also, the electroconductive film 6*a* also is shown as being completely separate from the electroconductive film 6*b* in FIGS. 2A and 2B. However, they may not be completely separate, depending on how they are formed, and may be connected (e.g., at tiny area), as long as not significantly affecting the electron emission characteristics.

In order to drive the surface conduction type electron-emitting device, an anode electrode is disposed so as to oppose the substrate 1, with the space between the substrate 1 and the anode electrode maintained in a vacuum. Then, a voltage is applied between the electrode 2 and the electrode 3 so that electrons tunnel from the electroconductive film 6*a* or 6*b* connected to the low-potential electrode 4*a* or 4*b* to the other one of the electroconductive films 6*a* or 6*b* connected to the other electrode (high-potential electrode) 4*a* or 4*b*. By applying a potential higher than that of the electrodes 2 and 3 to the anode electrode disposed with a distance (1 mm or more for practical use) from the substrate 1, some of the electrons that have tunneled reach the anode electrode. The electrons reaching the anode electrode are observed as electrons (emission current, $I_e$) emitted from the electron-emitting device to the anode electrode. Thus, the surface conduction type electron-emitting device has, basically, a diode structure, and an electron-emitting apparatus including the electron-emitting device has a triode structure. Another electrode (not shown) may of course be added for shaping the electron beams emitted from the electron-emitting device.

An embodiment for manufacturing the electron-emitting device shown in FIGS. 2A and 2B according to the method of the present invention will now be described with reference to FIGS. 6A to 6E.

Figure 6A:
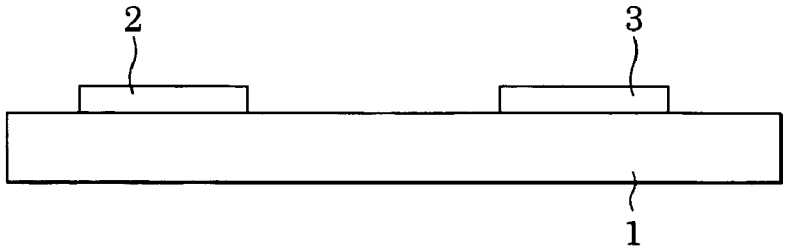
FIGS. 6A to 6E are schematic diagrams representing a process for manufacturing an electron-emitting device using the method of the present invention.

Step A: The first electrode 2 and the second electrode 3 are formed on the substrate 1 (FIG. 6A).

The substrate 1 may be typically composed of an insulating glass substrate. Examples of the substrate 1 include quartz glass, glass including a low concentration of impurities such as Na, soda lime glass, soda lime glass coated with a silicon oxide (typically $SiO_2$) layer by sputtering or the like, ceramics such as alumina, and a Si substrate.

The electrodes 2 and 3 may be made of a generally used conductive material. The material of the electrodes 2 and 3 may be selected from metals, such as Ni, Cr, Au, Mo, W, Pt, Ti, A, Cu, and Pd, and their alloys; printed conductors constituted of glass or the like and a metal or metal oxide, such as Pd, Ag, Au, $RuO_2$, or Pd—Ag; transparent conductors, such as $In_2O_3$—$SnO_2$; and semiconductor materials, such as polysilicon.

The interval (spacing) L (FIG. 2A) between the electrodes 2 and 3, the width (length in the direction perpendicular to the direction in which the electrodes 2 and 3 oppose each other) W (FIG. 2A) of the electrodes 2 and 3, and other dimensions are set according to predetermined operating criteria.

The interval (spacing) L between the electrodes 2 and 3 is preferably in the range of 100 nm to 900 μm, and more preferably in the range of 1 to 100 μm in view of the voltage applied between the electrodes 2 and 3.

The width W of the electrodes 2 and 3 is preferably in the range of 1 to 500 μm in view of the resistance of the electrodes and the electron emission characteristics. The thickness of the electrodes 2 and 3 is preferably in the range of 10 nm to 10 μm.

Figure 6B:
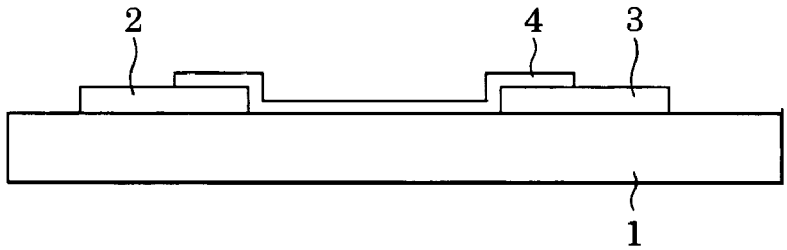

Step B: A conductive film 4 (FIG. 6B) (including portions 4*a* and 4*b*) is formed so as to connect the first electrode 2 to the second electrode 3 (FIG. 6B). The width W' (FIG. 2A) of the conductive film 4 is set according to predetermined operating criteria.

Although, in FIGS. 2A, 2B, and 6A to 6E, the electrodes 2 and 3 and the conductive film 4 (auxiliary electrodes 4*a* and 4*b*) are deposited in that order on the substrate 1, in other embodiments, the conductive film 4 may be deposited before depositing the electrodes 2 and 3.

The thickness of the conductive film 4 is set according to various factors, including the coating over the edges (steps) and resistance of the electrodes 2 and 3, and conditions for the "forming" process, described later. For example, the thickness can be set in the range of 5 to 50 nm.

If the "forming" process is performed in the subsequent Step C, it is preferable that the resistance of the conductive film 4 be high to some extent from the viewpoint of ease of the "forming" process. For example, the resistance can be in the range of $10^3$ to $10^7\Omega$ per square. However, the conductive film 4 after the "forming" process (after forming the gap 5') has preferably such a low resistance that sufficient voltage can be applied to the gap 5' through the electrodes 2 and 3.

The conductive film 4 may be formed of a metal such as Pd, Pt, Ru, Ag, or Au, an oxide such as PdO, $SnO_2$, or $In_2O_3$, a boride such as $HfB_2$, a carbide such as TiC or SiC, a nitride such as TiN, or a semiconductor such as Si or Ge by ink jet coating, spin coating, dipping, vacuum evaporation, sputtering, or other techniques.

Among the above-listed materials for the conductive film 4, PdO is suitable because of the following reasons:

(1) a PdO film is easily prepared by baking a film containing an organic Pd compound in a normal atmosphere;

(2) PdO has a wide process margin of thickness for ensuring a resistance in the foregoing range because PdO, which is a semiconductor, has a relatively low electric conductivity;

and (3) PdO can be easily turned into metallic Pd to lower the resistance of the film after forming the gap 5'.

Figure 6C:
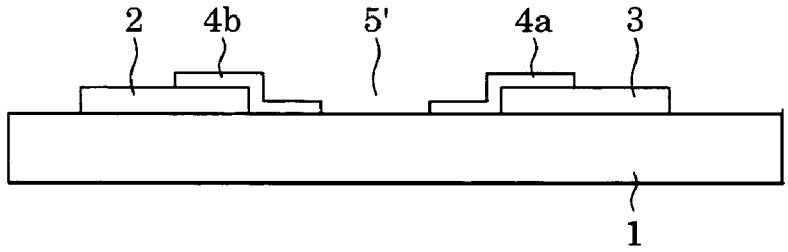

Step C: Then, the second gap 5' is formed in the conductive film 4 (FIG. 6C). Thus, the conductive film 4 is divided into the first auxiliary electrode 4*a* and the second auxiliary electrode 4*b* separated by the second gap 5'. The first auxiliary electrode 4*a* and the second auxiliary electrode 4*b* may not be completely separate, but may be connected (e.g., at a tiny area), as long as not significantly affecting the electron emission characteristics, as described above.

The second gap 5' can be formed by, for example, the "forming" process. The shape of the gap 5' depends on the thickness, texture, and material of the conductive film 4 and the process of, for example, the below-described "forming" process.

The "forming" process is performed to form the second gap 5' in the conductive film 4 with Joule heat generated by passing an electric current through the conductive film 4. For example, the "forming" process is performed in a vacuum atmosphere or a reducing gas atmosphere by applying a voltage between the electrodes 2 and 3.

By applying a voltage between the electrodes 2 and 3 (by applying the electric current to the electrodes), the second gap 5' is formed in a region of the conductive film 4. In this instance, a pulse voltage including a plurality of pulses with a constant peak voltage value is applied as shown in FIG. 3A, or pulses whose peak voltage values are gradually increased are applied as shown in FIG. 3B.

Figure 3A:
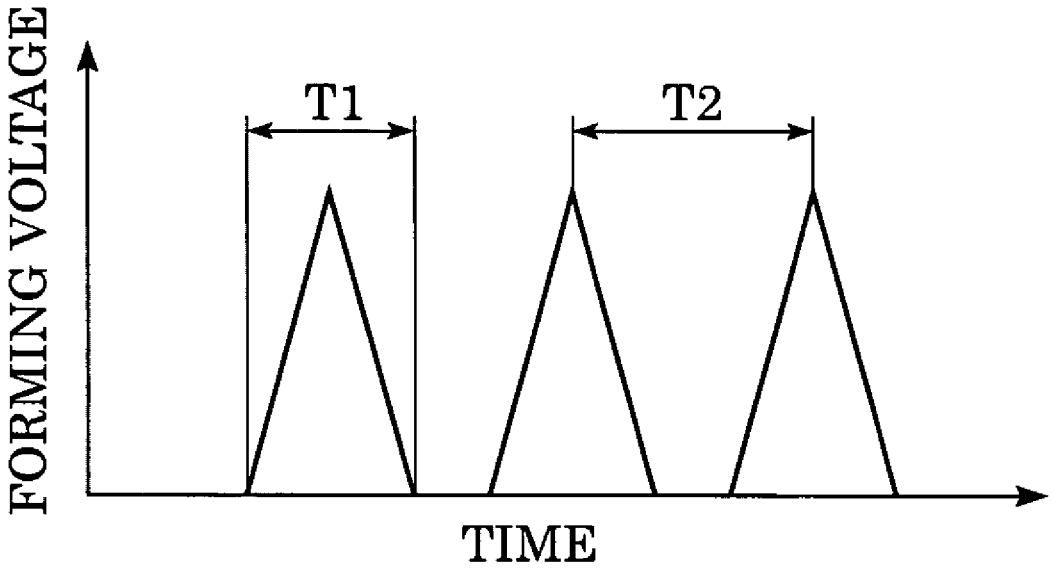
FIGS. 3A and 3B are schematic representations of waveforms of a voltage applied in a "forming" process.
Figure 3B:
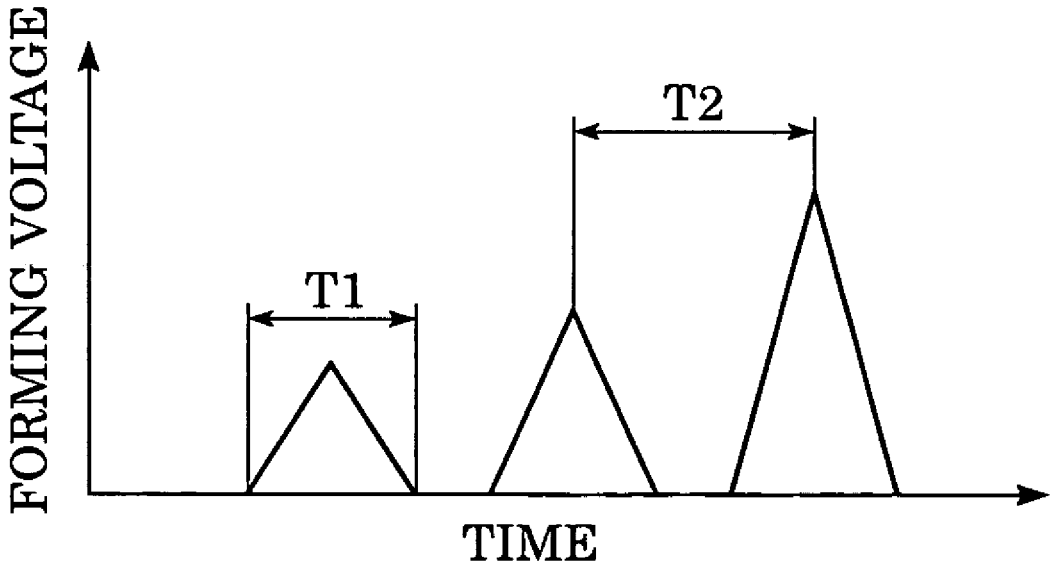

In the case of FIG. 3A, the pulse width T1 is Preferably in the range of 1 μs to 10 ms, and the pulse interval T2 is preferably in the range of 10 μs to 100 ms. The peak voltage value (peak voltage during the "forming" process) is appropriately set according to the material of the conductive film 4 and other factors. In the case of FIG. 3B, the pulse width T1 and the pulse interval T2 are the same as in FIG. 3A, and the peak voltage values and variation of the peak voltage values are appropriately set according to the material of the conductive film 4 and other factors.

If the conductive film 4 is made of a metal oxide, it is advantageous that the "forming" process is performed in an atmosphere containing a reducing gas, such as hydrogen. This is because the second gap 5' can be formed while the conductive film 4 is reduced. Thus, the conductive film 4 of the metal oxide provided in Step B is changed into auxiliary electrodes 4*a* and 4*b* mainly containing a metal by the "forming" process. Consequently, the parasitic resistance for driving the electron-emitting device can be reduced. Another step may be added to completely reduce the conductive film 4.

The termination of the "forming" process can be determined according to the resistance derived from the device current (passing through the electrodes 2 and 3) measured by applying a voltage to the extent that the conductive film 4 is not broken or deformed, for example, about 0.1 V, within an interval of the pulse voltage. For example, when the resistance reaches a value of at least 1000 times that before the "forming" process, the "forming" process may be terminated.

As an alternative to the "forming" process, electron-beam lithography or focused ion beam (FIB) processing may be employed to form the second gap 5'. If the conductive film 4 is not provided, the interval L between the electrodes 2 and 3 may be set at less than 100 nm in Step A to omit Steps B and C. It is however preferable that the "forming" process be performed, from the viewpoint of easy and quick formation of the second gap 5'

Figure 6D:
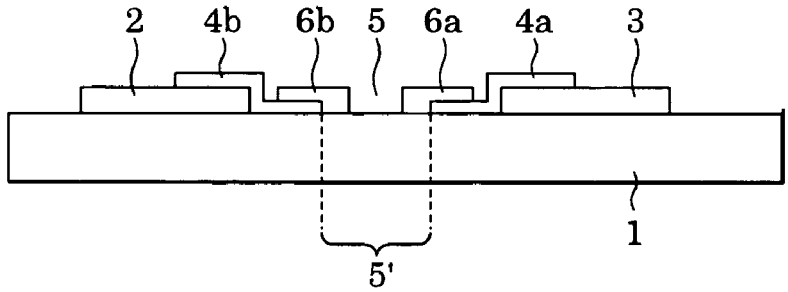

Step D: The first electroconductive film 6*a* and the second electroconductive film 6*b* are disposed on the substrate 1 in the second gap 5' and in regions close to the gap 5' of the auxiliary electrodes 4*a* and 4*b* (FIG. 6D).

The electroconductive films 6*a* and 6*b* are formed by, for example, "activation" process. The "activation" process is performed by introducing, for example, an appropriate carbon-containing gas in a vacuum and applying pulse voltage including a plurality of pulses between the electrodes 2 and 3. The "activation" process can greatly increase the electron emission current. Thus, first and second carbon electroconductive films 6*a* and 6*b* are formed. The carbon-containing gas for the "activation" process may of course be replaced with a metal-containing gas to form metal-containing electroconductive films 6*a* and 6*b*.

The pressure of the carbon-containing gas used for the "activation" process is set depending on the application of the electron-emitting device and the type of the carbon-containing gas.

The carbon-containing gas can be a carbon compound. Suitable carbon compounds include aliphatic hydrocarbons, such as alkanes, alkenes, alkynes; aromatic hydrocarbons; alcohols; aldehydes; ketones; amines; phenols; and organic acids, such as carboxylic acids and sulfonic acids. The pressure of the carbon compound gas depends to some extent on the shape and components of the vacuum apparatus and the type of carbon compound. If tolunitrile, which is suitable for the "activation" process, is used, the pressure can be preferably set in the range of $1\times10^{-5}$ to $1\times10^{-2}$ Pa.

By applying a pulse voltage having a plurality of pulses between the electrodes 2 and 3 in the presence of the carbon compound, the carbon compound in the atmosphere forms carbon films or the electroconductive films 6*a* and 6*b* containing carbon and/or a carbon compound.

Figure 4A:
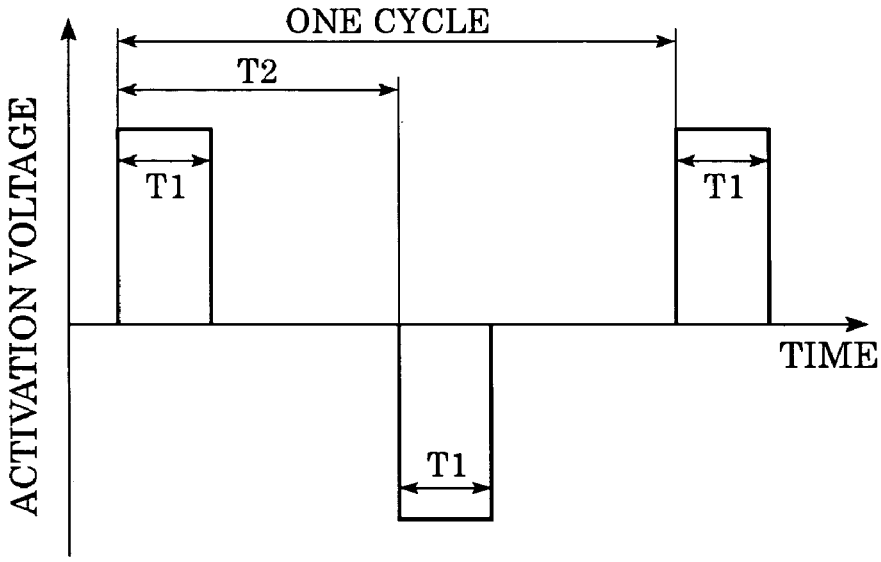
FIGS. 4A and 4B are waveforms of a voltage applied in an "activation" process.
Figure 4B:
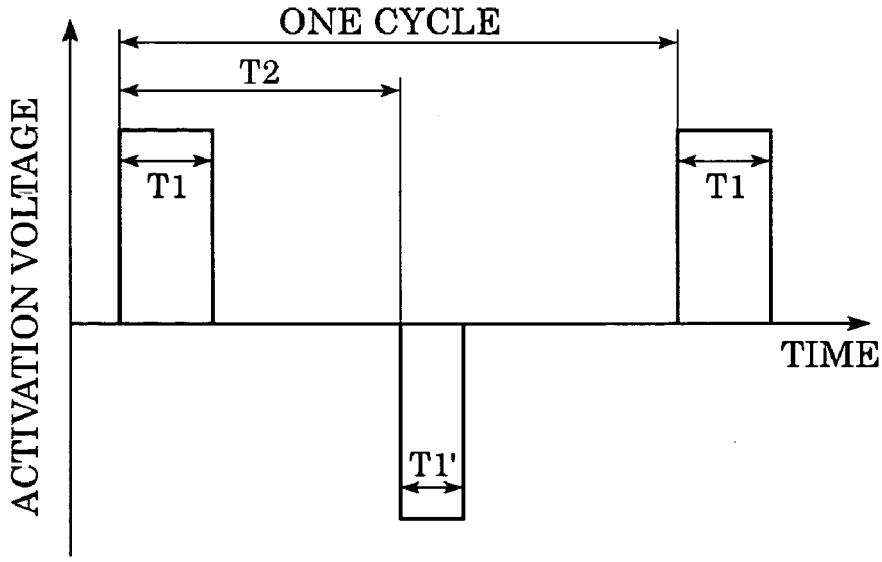

FIGS. 4A and 4B show preferred waveforms of an applied pulse voltage for the "activation" process. The maximum applied voltage of pulses is preferably set in the range of 10 to 25 V. In FIG. 4A, T1 represents the pulse width of positive and negative pulses, and T2 represents the pulse interval. The absolute voltage values of positive and negative pulses are set constant. In FIG. 4B, T1 and T1' represent the pulse widths of the pulses with positive voltage and negative voltage, respectively, and T2 represents the pulse interval. The absolute voltage values of positive and negative pulses are respectively set constant with the relationship T1>T1'.

The termination of the "activation" process can be determined, for example, according to the device current (passing through the electrodes 2 and 3, $I_f$) or the emission current (transmitted to the anode electrode, $I_e$) measured during the "activation" process. When the device current and/or the emission current reaches a predetermined value, the "activation" process may be terminated. The pulse width, pulse interval, peak value, and other properties of the applied voltage are set according to the type and pressure of the carbon compound.

Although the first electroconductive film 6*a* is completely separate from the second electroconductive film 6*b* in FIGS. 2A and 2B and FIG. 6D, they may not be completely separate, depending on how they are formed, and may be connected (e.g., at a tiny area), as long as not affecting the electron emission characteristics.

A first gap 5 is formed between the first electroconductive film 6*a* and the second electroconductive film 6*b* formed by the "activation" process. A voltage is applied between the electrodes 2 and 3 to generate a strong electric field in the first gap 5, in driving the electron-emitting device. Consequently, electrons tunnel from the electroconductive film (6*a* or 6*b*, carbon film) connected to the low-potential electrode (2 or 3) to the electroconductive film (carbon film) connected to the other electrode (high-potential electrode). Thus, a region, which is a part of the electroconductive film connected to the low-potential electrode and is in the vicinity of the first gap 5, serves as the electron-emitting portion. More specifically, the electroconductive film connected to the low-potential electrode basically functions as the electron-emitting member. In addition, the electroconductive film connected to the high-potential electrode may be regard as the electron-emitting member, because it is considered that most of the electrons, tunneled from the electroconductive film connected to the low-potential electrode, scatter at the electroconductive film connected to the high-potential electrode. Thus, in the surface conduction type electron-emitting device according to the present invention, both the first electroconductive film 6*a* and the second electroconductive film 6*b* may be regarded as electron-emitting members. The first gap 5 has a smaller width than the second gap 5' and is positioned inside the second gap 5'.

In the present embodiment, the first electroconductive film 6*a* and the second electroconductive film 6*b* are formed by the "activation" process. However, in other embodiments, they may be formed by electron beam lithography, FIB processing, or the like without performing the "activation" process, as long as an interval of 50 nm or less, preferably 3 to 10 nm, is ensured between the first electroconductive film 6*a* and the second electroconductive film 6*b*.

Figure 6E:
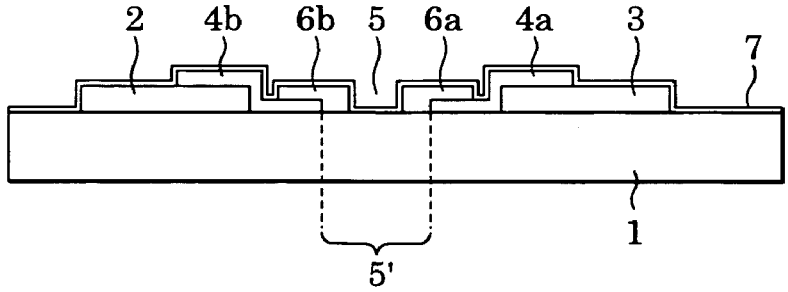

Step E: An oxidizing gas (an oxygen-containing gas) and a metal-containing gas are alternately introduced to form the coating film 7 over the surface of the electron-emitting device (at least the surface of the electron-emitting member or electron-emitting portion), with the substrate 1 maintained at a desired temperature (FIG. 6E).

The metal-containing gas may contain a material providing a higher heat resistance than that of the electroconductive films 6*a* and 6*b* (and the auxiliary electrodes 4*a* and 4*b*), from the viewpoint of enhancing the heat resistance of the surfaces of the electron-emitting portion and their vicinities to suppress the changes in characteristics and to increase the electron emission efficiency. It is preferable to use a gas of a metal compound (a metal compound gas) as the metal-containing gas. The metal compound may include a metal to be formed into the coating film 7. Examples of such metal compound gases include $Zr(NMe_2)_4$, $Zr(NEtMe)_4$, $Ti(NMe_2)_4$, $Ti(NEt_2)_4$, $Pt(EtCp)Me_3$, $Ru(EtCp)Me_3$, $Ta(OEt)_5$, $Ge(OMe)_4$, $Bi(dpm)_3$, $La(dpm)_3$, $Ta(OEt)_5$, $Cr(dpm)_3$, and $Ni(dpm)_3$.

In order to reduce the work function of the surface of the electron-emitting portion and their vicinities to increase an emission current density and/or to enhance the electron emission efficiency, the metal-containing gas may contain a material providing a substantially lower work function than the electroconductive films 6*a* and 6*b*. Examples of such gases include $Hf[N(CH_3)_2]_4$, $Ba(C_{11}H_{19}O_2)_2$ and $Li(C_{11}H_{19}O_2)$.

Thus, a surface conduction type electron-emitting device having the coating film 7 at the surface thereof may be produced through the above-described Steps A to E.

In the method of the present invention, the coating film 7 may be formed in all the areas exposed to the gases. Consequently, if the coating film 7 has a high conductivity, the resistance between the electrodes may relatively decrease to cause short-circuiting (leakage current) between the electrodes. Accordingly, it is necessary to pay attention to the thickness of the coating film 7. However, if the substrate 1 is made of an insulator, the coating film 7 having an appropriate thickness may suppress a charging of the surface of the substrate during operation of the electron-emitting device. An additional step may be performed to remove unnecessary portions of the coating film from which leakage current may occur, after the formation of the coating film 7. By additionally performing such a step, the short-circuiting (leakage current) between the electrodes can be reduced. Various methods can be employed to reduce the short-circuiting (leakage current) between the electrodes.

Figure 7:
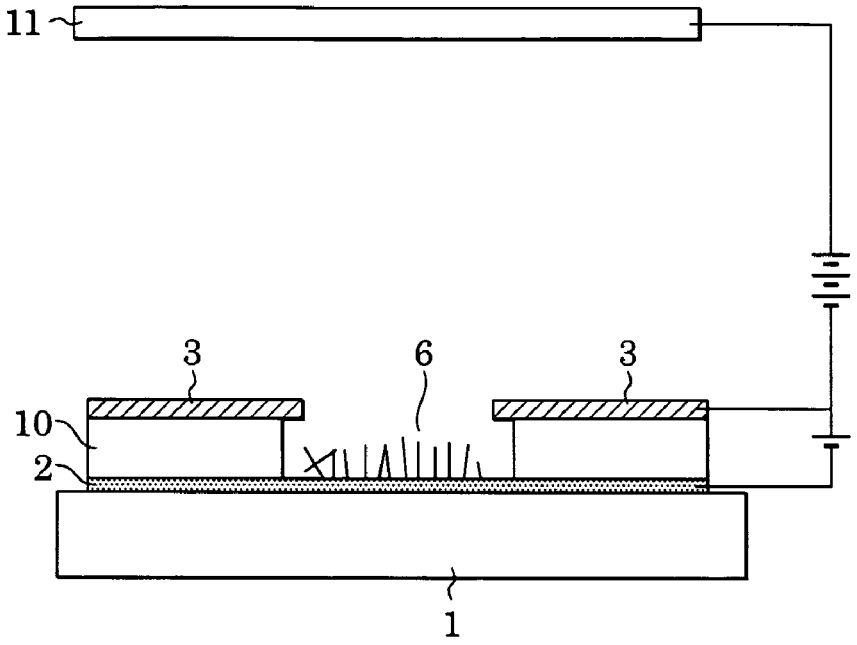
FIG. 7 is a schematic diagram of another electron-emitting device to which the present invention can be applied.

Although the above embodiment is described in the context of a surface conduction type electron-emitting device, the method of the present invention also can be applied to, for example, field emission type electron-emitting devices using carbon fibers 6, such as carbon nanotubes, as the electron-emitting member, as shown in FIG. 7.

In FIG. 7, numeral 1 denotes a substrate 1, numeral 2 denotes a cathode electrode, numeral 3 denotes a control electrode (may be used as a gate electrode), numeral 6 denotes carbon fibers, numeral 10 denotes an insulating layer, and numeral 11 denotes an anode electrode.

While the field emission type electron-emitting device shown in FIG. 7 has the cathode electrode 2 and the control electrode 3, the present invention can be applied to another form of field emission type electron-emitting devices, not including the control electrode (and the insulating layer 10) because the carbon fibers 6 can emit electrons at a low field intensity. Specifically, the present invention can be applied to an electron-emitting device (diode or two-terminal type electron-emitting device, including the anode electrode 11) including a cathode electrode 2 and carbon fibers 6 disposed in that order on a substrate 1.

In the electron-emitting device shown in FIG. 7, which is of a triode type, the control electrode 3 may serve as a so-called gate electrode (for extracting electrons from the carbon fibers 6). However, since the carbon fibers 6 can emit electrons at a low electric field intensity, the anode electrode 11 may extract electrons from the carbon fibers 6 and the control electrode 3 may be used for varying the quantity of electrons emitted from the carbon fibers, suspending the electron emission, focusing emitted electron beams, and performing other control. In this instance, a lower potential may be applied to the control electrode 3 than to the cathode electrode 2.

In order to manufacture this type of electron-emitting device, Steps A to D in the process for manufacturing the above-described surface conduction type electron-emitting device may be replaced with the following steps A' and B', and subsequently Step E is performed. Thus, the coating film 7 is formed on the surface of at least the electron-emitting member, that is, the carbon fibers 6, of the electron-emitting device, according to the method of the present invention.

Step A': A cathode electrode 2, an insulating layer 10, and a control electrode 3 are deposited on a substrate 1, and subsequently an opening passing through the control electrode 3 and the insulating layer 10 is formed to prepare a structure to which carbon fibers 6 are to be arranged.

Step B': Many catalytic particles (for example, particles of a Pd—Co alloy) are deposited on the surface of the cathode electrode 2 exposed in the opening. Then, thermal CVD process is performed by use of a carbon-containing gas, thereby a plurality of carbon fibers are formed on the cathode electrode 2 located in the opening. Alternatively, a printing paste (not shown) containing a plurality of carbon fibers may be applied to the inside of the opening, followed by drying and/or baking processes. Thus, carbon fibers 6 are formed on the cathode electrode 2 located in the opening. If the carbon fibers are embedded in the matrix of the paste, an additional step can be performed to remove a part of the matrix (for example, glass) of the paste overlying the carbon fibers 6. For this removing step, a laser irradiation process may be employed, for example. This removing step may enhance the electron emission amount from the carbon fibers.

Figure 8:
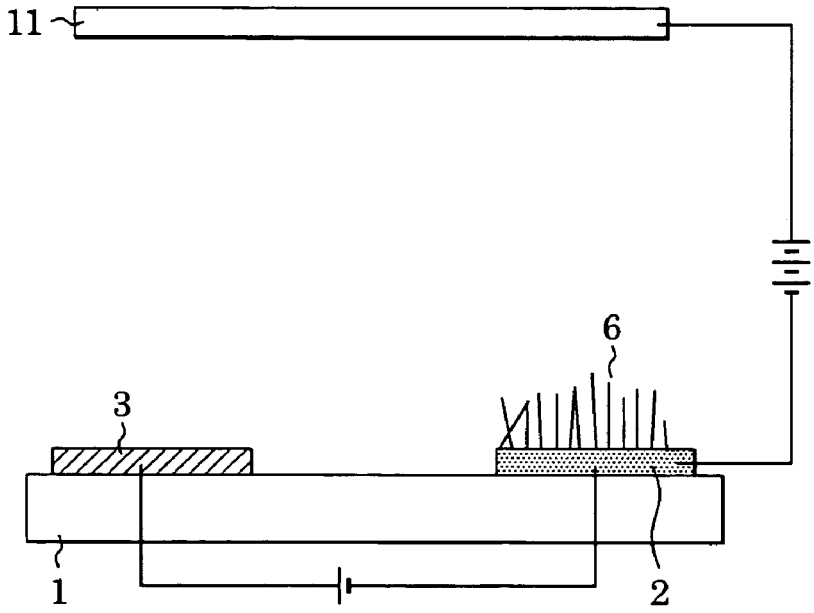
FIG. 8 is a schematic diagram of another electron-emitting device to which the present invention can be applied.

While this electron-emitting device using carbon fibers is of a vertical type, in another embodiment there can be another form of electron-emitting device using carbon fibers, in which the control electrode 3 and the cathode electrode 2 are disposed side by side on the substrate 1, as shown in FIG. 8. This form is of a lateral type. In FIG. 8, reference numeral 1 represents the substrate, numeral 2 denotes the cathode electrode, numeral 3 denotes the control electrode (may be used as the gate electrode), numeral 6 denotes the carbon fibers, and numeral 11 denotes the anode electrode.

In the present invention, the carbon fibers 6 contain carbon, and preferably carbon is the principal constituent of the carbon fibers. The carbon fibers 6 have a diameter in the range of 1 nm to less than 1 μm, preferably 1 to 500 nm, and more preferably 5 to 100 nm from the viewpoint of providing a stable emission current $I_e$. The length of the carbon fibers may be at least 10 times the diameter, in practical use. In order to increase the applied electric field intensity, the length of the carbon fibers is preferably at least 50 times the diameter, and more preferably at least 100 times the diameter.

Graphite is composed of carbon sheets stacked, ideally at intervals of about 3.354 Å between the sheets. The carbon sheets are each formed by closely laying units of hexagonally arranged carbon atoms formed by covalent bonds with $sp^2$ hybrids. Each of the carbon sheets is called "graphene" or a "graphene sheet".

Graphene in a cylindrical form is called a "carbon nanotube". A cylinder in which a plurality of graphene sheets are nested is referred to as a multi-walled carbon nanotube. A single-layer cylinder of graphene is referred to as a single-walled carbon nanotube. In particular, a carbon nanotube whose ends are not closed has a low threshold of electric field for electron emission. Although some of the multi-walled carbon nanotubes have a structure similar to bamboo joints in their hollows, the outermost graphene of this type of carbon fiber often lies at an angle of about 0° to the longitudinal direction (axis direction) of the fiber and this type can also be called the carbon nanotube. The carbon nanotube features a hollow structure in which the surface of the outermost, cylindrically formed graphene is substantially parallel to the axis direction (longitudinal direction) of the fiber (the graphene and the fiber axis form an angle of about 0°).

In another type of carbon fiber, a plurality of graphene sheets (not shown) may be stacked in the axis direction of the fiber. This type of carbon fiber is called a "graphite nanofiber" and is distinguished from the carbon nanotube. More specifically, while the carbon nanotube has a c axis (extending in the direction in which the plurality of graphene sheets are stacked, or the direction perpendicular to the surfaces of the graphene sheets) substantially perpendicular to the axis of the fibers (longitudinal direction of the fibers), the graphite nanofiber has a c axis nonperpendicular (typically parallel) to the axis of the individual fibers. Typically, c axes of the graphenes in the graphite nanofiber are settled in 20° to 90° relative to the axes of the fibers.

When an angular difference between the axis of a fiber and the surface of graphene (carbon sheet or carbon plane) is almost 90°, the fiber is called the platelet type. In the platelet type, many graphene sheets are stacked along the axis like playing cards. On the other hand, when the axis of the fiber forms an angle of larger than 0° to less than 90° (typically 10° to less than 90°) with the surface of graphene, the fiber is called the herringbone type. Herringbone type fibers may have a structure in which graphene sheets formed into a bottomless cup-like shape are stacked or a structure resembling opened books that are stacked (V-shaped graphene sheets are stacked).

The central axis and its vicinity of the herringbone type fiber may be hollow or filled with amorphous carbon (which does not show clear spots according to the crystal lattice or a bright and dark crystal lattice pattern, but shows a broad ring pattern or the like, in electron diffraction at a level of TEM).

Although FIG. 7 shows highly linear carbon fibers, less linear or bent fibers may be used in other embodiments.

Both the carbon nanotube and the graphite nanofiber have an electron emission threshold of about 1 to 10 V/μm, and thus have a suitable property for an electron-emitting material. If the carbon fiber is used as the electron-emitting member of an electron-emitting device, the single electron-emitting device preferably includes a plurality of carbon fibers.

For the electron-emitting member, graphite nanofibers are more suitable than carbon nanotubes because an electron-emitting device having an electron-emitting member containing graphite nanofibers provides a higher electron emission current density than an electron-emitting device using carbon nanotubes.

Since the graphite nanofiber has microscopic asperities on the surface (periphery) unlike the carbon nanotube, it apparently easily causes electric field concentration and easily emits electrons from its surface. Also, since in the graphite nanofiber, edges of the graphene sheets are set toward the periphery (surface) of the fiber, it is considered that the graphite nanofiber can easily emit electrons.

The above-described embodiment is described in the context of a case where a coating film 7 is formed for an electron-emitting device alone. In the case of an electron source including a plurality of electron-emitting devices on a substrate, after the plurality of electron-emitting devices are formed on the substrate 1 (i.e., all components of the devices besides film 7), the coating film 7 can be formed on the devices and substrate 1 by substantially the same method.

If an image display device, described below, is produced, an additional step, for example, a sealing step, is required after the formation of the coating film 7. Such a step is preferably performed in a vacuum without exposing the electron-emitting devices to a normal atmosphere.

An electron source and an image display device, each including a plurality of electron-emitting devices, manufactured by the method according to the present invention, will now be described.

Figure 5:
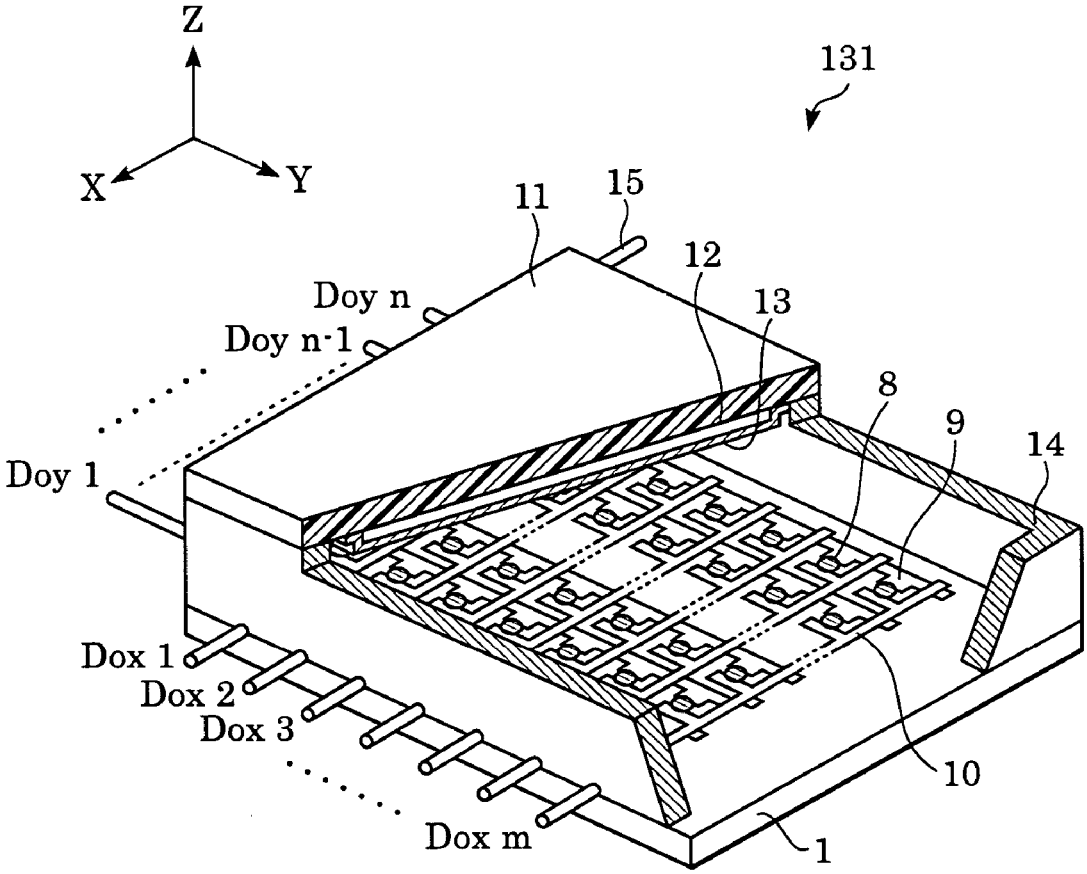
FIG. 5 is a partially cut-away perspective view of an image display device to which the present invention can be applied.

FIG. 5 is a partially cut-away perspective view of an envelope (display panel) 131 of an image display device according to the present invention.

As shown in FIG. 5, an electron source constituted of a large number of electron-emitting devices 8 is disposed on a rear plate (substrate) 1. This display panel preferably uses surface conduction type electron-emitting devices as shown in FIGS. 2A and 2B. The surface of the rear plate 1 may be almost entirely coated with the above-described metal or metal compound coating film 7.

Y-directional wirings (lower wirings) 9 each of which connects a plurality of the second electrodes 3 (or the second auxiliary electrodes 4*b* or the second electroconductive films 6*b*) of corresponding electron-emitting devices 8 are arranged on the rear plate 1, and X-directional wirings (upper wirings) 10 are disposed over the Y-directional wirings with an insulating layer (not shown) therebetween. The X-directional wirings 10 intersect with the Y-directional wirings 9, and a plurality of the first electrodes 2 (or the first auxiliary electrodes 4*a* or the first electroconductive films 6*a*) are connected to the corresponding X-directional wiring through a contact hole (not shown) formed in the insulating layer. Thus, each electron-emitting device is selectively driven by applying a voltage between the electrodes 2 and 3 through the Y-directional wiring 9 and the X-directional wiring 10. The material, thickness, and width of the Y-directional wirings 9 and the X-directional wirings 10 are appropriately selected so that the wirings can supply substantially uniform voltage. The Y- and X-directional wirings 9 and 10 and the insulating layer can be formed by, for example, a combination of printing or sputtering and photolithography.

A light-emitting member 12 and a metal back 13 are provided over the inner surface of a faceplate 11 made of glass or the other transparent insulating material so as to oppose the rear plate 1. The metal back 13 is a conductive film corresponding to the above-described anode electrode. Reference numeral 14 represents a supporting frame, and it is bonded to the rear plate 1 and the faceplate 11 with an adhesive, such as frit glass (not shown). Thus, the display panel 131 is structured, maintaining airtightness inside. The faceplate 11 may have a distance in the range of 1 to 10 mm from the rear plate 1, in practical use.

The internal space of the display panel (envelope) 131, surrounded by the rear plate 1, the supporting frame 14, and the faceplate 11 is maintained in a vacuum. This vacuum state can be formed by evacuating the internal space with an exhaust pipe provided through the rear plate 1 or the faceplate 11, and by subsequently closing the exhaust pipe. Also, the bonding of the supporting frame 14, the rear plate 1, and the faceplate 11 may be performed in a vacuum chamber to facilitate the production of the display panel (envelope) 131 maintaining airtightness inside. This is advantageous because the bonding in a vacuum chamber suppresses the electron-emitting devices from being exposed to air (a normal atmosphere) after the formation of the coating film 7.

In order to display images, a drive circuit (not shown) for driving the electron-emitting devices 8 is connected to the above-described display panel 131 (image forming device), and a voltage is applied to desired pairs of the electrodes 2 and 3 through the Y-directional wirings 9 and the X-directional wirings 10 to emit electrons from the electron emitting portions while a high voltage in the range of 5 to 30 kV is applied from a high voltage terminal 15 to the metal back 13 or anode electrode so that the electron beams impinge on the light-emitting member (such as a phosphor film) 12. In addition, a spacer serving as a support, not shown, may be disposed between the faceplate 11 and the rear plate 1 to enhance the strength against atmospheric pressure.

The display panel (envelope) 131 shown in FIG. 5 may be used in an information displaying/reproducing apparatus.

For example, the information displaying/reproducing apparatus has a receiver for receiving signals of TV and other broadcasts and a tuner for selection signals. At least one of video information, character information, and sound information contained in a selected signal is output to the display panel 131, thereby being displayed or reproduced on the screen. The information displaying/reproducing apparatus, such as a TV set, has such a structure. If broadcast signals are encoded, the information displaying/reproducing apparatus of the present invention may have a decoder. The sound information is output to an additionally provided sound-reproducing unit, such as a loudspeaker, to be reproduced while being synchronized with the video and character information displayed on the display panel 131.

In order to output video information or character information to the display panel 131 to display and/or reproduce, the following process may be used. First, video signals are generated from received video information or character information according to the pixels of the display panel 131. The video signals are input to the drive circuit of the display panel 131. Then, the voltage applied to the electron-emitting device of the display panel 131 from the drive circuit is controlled according to the video signals input to the drive circuit, and thus images are displayed.

Figure 9:
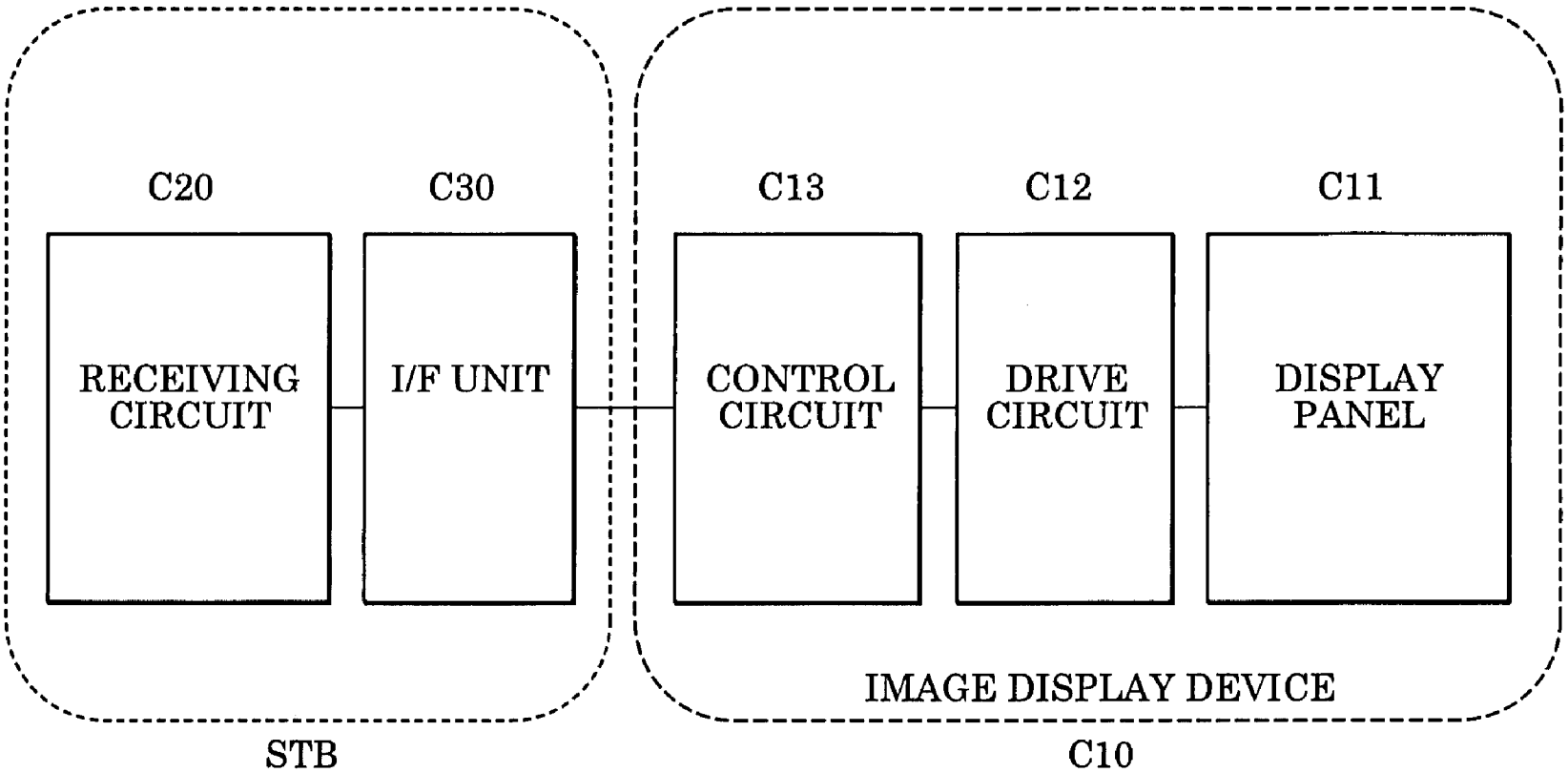
FIG. 9 is a block diagram of an information displaying/reproducing apparatus according to the present invention.

FIG. 9 is a block diagram of a TV set according to the present invention. A receiving circuit C20, which includes a tuner and a decoder, receives TV signals for satellite or ground wave broadcasting, or data broadcast signals through a network, and decoded video data is output to an I/F UNIT (interface) C30. The I/F UNIT C30 converts the video data into a display format of an image display device and outputs the video data to the display panel 131 (C11). The image display device C10 includes the display panel 131 (C11), the drive circuit C12, and the control circuit C13. The control circuit C13 processes input image data so as to be suitable for the display panel, and output image data and various types of control signals to the drive circuit C12. The drive circuit C12 outputs driving signals to the terminals of the wirings (see Dox1 to Doxm and Doy1 to Doyn in FIG. 5) of the display panel 131(C11) according to the input image data, and thus TV videos are displayed. The receiving circuit C20 and the I/F UNIT C30 may be accommodated in a set top box (STB) different from the case of the image display device C10, or in the image display device C10.

An input and/or output interface may be provided to connect the components of FIG. 9 to image recording and output devices, such as a printer, digital video camera, digital camera, hard disk drive (HDD), and digital video disk (DVD), to constitute an information displaying/reproducing apparatus (or TV set) that can display images recorded in the image recording device on the display panel 131, or can process the images displayed on the display panel 131 as required and output the image to the image output device.

The structure of the information displaying/reproducing apparatus has been described as an example, and various modifications may be made according to the scope and spirit of the present invention. Also, various types of information displaying/reproducing apparatus can be provided according to the present invention, by connecting the apparatus to a video conference system, a computer, and other systems.

EXAMPLES

The present invention will be further described with reference to examples. However, the invention is not intended to be limited to these examples and various modifications can be made in form and detail without departing from the scope of the invention.

Example 1

The electron-emitting device produced in Example 1 has the same structure as in FIGS. 2A and 2B. The process for manufacturing the electron-emitting device of the present example will be described with reference to FIGS. 2A, 2B, and 6A to 6E.

Step a: A silicon oxide layer was deposited to a thickness of 0.5 μm on a cleaned soda lime glass by sputtering. The resulting composite was used as the substrate 1. A host resist pattern was formed on the substrate 1, and subsequently a 5 nm thick Ti layer and a 100 nm thick Ni layer were deposited in that order by vacuum deposition. Then, the host resist pattern was dissolved in an organic solvent to form electrodes 2 and 3 by lift-off of the Ni and Ti deposition layers (FIG. 6A). The electrodes 2 and 3 had an interval L of 3 μm therebetween, and a width W of 300 μm.

Step b: A Cr mask was formed for forming a conductive film 4. Specifically, a 100 nm thick Cr layer was deposited on the substrate 1 having the electrode 2 and 3 by vacuum deposition, and a recess was formed in the Cr layer according to the shape of the conductive film 4 by known photolithography. The resulting film was used as the Cr mask. A Pd-amine complex solution was applied onto the Cr mask by spin coating, followed by baking at 300° C. for 10 minutes in a normal atmosphere. The resulting film mainly contained PdO and had a thickness of about 10 nm.

Step c: The Cr mask was removed by wet etching. The PdO film was patterned into the conductive film 4 having a desired shape by lift-off (FIG. 6B). The conductive film 4 had a resistance Rs of $2\times10^4\Omega$ per square.

Step d: The substrate 1 having the conductive film 4 was placed in a vacuum chamber and subjected to the "forming" process. Specifically, the vacuum chamber was evacuated to a pressure of $2.3\times10^{-3}$ Pa with an evacuation apparatus, and a pulse voltage was applied (pulses were applied) between the electrodes 2 and 3 to perform the "forming" process. Thus, a gap 5' was formed in the conductive film 4 (FIG. 6C).

Step e: Tolunitrile was introduced into the vacuum chamber through a slow leak valve and the internal pressure of the vacuum chamber was adjusted to be maintained at $1.3\times10^{-4}$ Pa. Pulses were repeatedly applied between the electrodes 2 and 3 to perform the "activation" process. Thus, carbon films 6*a* and 6*b*, or first and second electroconductive films, were formed (FIG. 6D).

Step f: The vacuum chamber was evacuated to a pressure of $1\times10^{-6}$ Pa, and water ($H_2O$ gas) and an organic gas containing hafnium ($Hf[N(CH_3)_2]_4$, tetrakis(dimethylamino)hafnium) were alternately introduced through a switching valve to form a coating film 7 containing hafnium (FIG. 6E).

The temperature of the substrate 1 was maintained at 100° C. during Step f. Each gas was introduced to a pressure of 1 Pa, held at this pressure for 10 seconds, and each gas was evacuated for 10 seconds in a sequence of Step f, and the sequence was repeated 100 cycles.

The resulting electron-emitting device was driven in the vacuum chamber and the electron emission characteristics were evaluated in comparison with those of the electron-emitting device produced through Steps a to e without Step f. The device current $I_f$ of the electron-emitting device of the present example was increased to 1.5 times and the emission current $I_e$ was increased to 2 times, at a driving current of 18 V; hence the electron emission efficiency ($I_e/I_f$) was 30% increased.

The electron-emitting device produced in the present example was subjected to surface elementary analysis. As a result, hafnium was detected from the entire surface of the electron-emitting device. Thus, it was confirmed that a coating film containing hafnium was formed by the process of the present example.

The comparison of voltage/current characteristics between the electron-emitting devices produced in the present example and by only Steps a to e suggested that the effective work function of the electron-emitting device of the present example was substantially reduced. The driving voltage for obtaining a desired emission current was reduced by about 2 V.

Example 2

In Example 2, the carbon-containing gas tolunitrile used for the "activation" process in Example 1 was replaced with $Hf[N(CH_3)_2]_4$ (tetrakis(dimethylamino)hafnium) gas. The partial pressure of the tetrakis(dimethylamino)hafnium gas was set at $1\times10^{-4}$ Pa for the "activation" process.

The characteristics of the electron-emitting device after the "activation" process were examined. As a result, the electron-emitting device of the present example exhibited the same characteristics as those of the device produced by Steps a to e without Step f, but the emission current and electron emission efficiency were not increased, unlike the electron-emitting device of Example 1.

Then, after the "activation" process using tetrakis(dimethylamino)hafnium gas, the sequence of the following Steps A and B was repeated 50 cycles with the temperature of the substrate 1 maintained at 85° C.

Step A: $H_2O$ gas was introduced into the vacuum chamber until the pressure was increased to 3000 Pa, and the pressure was maintained for 5 seconds. Subsequently, the vacuum chamber was evacuated to a pressure of about 10 Pa.

Step B: $Hf[N(CH_3)_2]_4$ (tetrakis(dimethylamino)hafnium) gas was introduced into the vacuum chamber until the pressure was increased to 1000 Pa, and the pressure was maintained for 5 seconds. Subsequently, the vacuum chamber was evacuated to a pressure of about 10 Pa.

Then, the electron emission characteristics of the resulting electron-emitting device were examined as in Example 1. As a result, the electron-emitting device exhibited increases in emission current and efficiency as in Example 1.

The electron-emitting device was subjected to surface elementary analysis. As a result, hafnium was detected from the entire surface of the electron-emitting device. Thus, it was confirmed that a coating film containing hafnium was formed by the process of the present example.

Example 3

In Example 3, the tetrakis(dimethylamino)hafnium used in Example 1 was replaced with $Ti[N(CH_3)_2]_4$ (tetrakis(dimethylamino)titanium) and an electron-emitting device was produced. The characteristics of the resulting electron-emitting device were evaluated.

In the production process of the electron-emitting device in the present example, Steps a to e were performed in the same manner as in Example 1. Then, Step f was performed by repeating the sequence of the following Step A and Step B 100 cycles with the temperature of the substrate 1 maintained at 85° C.

Step A: $H_2O$ gas was introduced into the vacuum chamber until the pressure was increased to 1000 Pa, and the pressure was maintained for 10 seconds. Subsequently, the vacuum chamber was evacuated to a pressure of about 10 Pa.

Step B: $Ti[N(CH_3)_2]_4$ (tetrakis(dimethylamino)titanium) gas was introduced into the vacuum chamber until the pressure was increased to 1000 Pa, and the pressure was maintained for 10 seconds. Subsequently, the vacuum chamber was evacuated to a pressure of about 10 Pa.

The characteristics of the resulting electron-emitting device were examined. As a result, the device current $I_f$ was not changed before and after the formation of the coating film, but the emission current $I_e$ was increased. Thus, it was found that the electron emission efficiency was increased.

However, the emission current was not increased at a lower driving voltage, unlike the case of Example 1 where the hafnium-containing coating film was provided. Also, the decrease in the work function of the electron-emitting portion was less than that of the electron-emitting device of Example 1.

Example 4

In Example 4, tetrakis(dimethylamino)hafnium used in Example 1 was replaced with $Zr[N(CH_3)_2]_4$ (tetrakis(dimethylamino)zirconium) and an electron-emitting device was produced. The characteristics of the resulting electron-emitting device were evaluated.

In the production process of the electron-emitting device in the present example, Steps a to e were performed in the same manner as in Example 1. Then, Step f was performed by repeating the sequence of the following Step A and Step B 100 cycles with the temperature of the substrate 1 maintained at 85° C.

Step A: $H_2O$ gas was introduced into the vacuum chamber until the pressure was increased to 1000 Pa, and the pressure was maintained for 10 seconds. Subsequently, the vacuum chamber was evacuated to a pressure of about 10 Pa.

Step B: $Zr[N(CH_3)_2]_4$ (tetrakis(dimethylamino)zirconium) gas was introduced to the vacuum chamber until the pressure was increased to 1000 Pa, and the pressure was maintained for 10 seconds. Subsequently, the vacuum chamber was evacuated to a pressure of about 10 Pa.

The characteristics of the resulting electron-emitting device were examined. As a result, the device current $I_f$ was not changed before and after the formation of the coating film, but the emission current $I_e$ was increased to 2 times. Consequently, the electron emission efficiency was increased to 2 times.

Example 5

In Example 5, the image display device shown in FIG. 5 was produced.

First, a Pt paste was printed on a rear plate (substrate) 1 having a $SiO_2$ layer by offset printing, followed by baking. Thus, units each including a pair of electrodes 2 and 3 were formed: 240 units in the Y direction and 720 units in the X direction. Also, 240 Y-directional wirings 9 and 720 X-directional wirings 10 were formed by screen printing of an Ag paste and subsequent baking. The intersections of the Y-directional wirings 9 and the X-directional wirings 10 were provided with an insulating layer (not shown) by screen printing of an insulating paste and subsequent baking. In each unit of electrodes 2 and 3, the electrode 2 was connected to one of the X-directional wirings and the electrode 3 was connected to one of the Y-directional wirings.

Then, a palladium complex solution was applied between the electrodes 2 and 3 by ink jet printing method and baked at 350° C. for 30 minutes to form a conductive film 4 of palladium oxide.

Thus, the rear plate 1 was provided with pairs of electrodes 2 and 3, the conductive films 4 lying astride the electrodes 2 and 3, the Y-directional wirings 9, and the X-directional wirings 10 lying thereon.

Then, a hood (not shown) was disposed over the rear plate 1 so as to cover the units each including a pair of electrodes (2, 3) and palladium oxide film, and the space defined by the rear plate 1 and the hood was evacuated to a pressure of about $1.33\times10^{-1}$ Pa. In this instance, the ends of the Y-directional wirings 8 and the X-directional wirings 10 were exposed to the air to serve as terminals.

The space defined by the rear plate 1 and the hood was further evacuated until the internal pressure was reduced to $2\times10^{-3}$ Pa with a vacuum pump (not shown).

Then, a hydrogen-containing nitrogen gas was introduced into the space between the rear plate 1 and the hood, and a pulse voltage was applied between the electrode 2 and 3 through the terminals (ends exposed to air) of the Y-directional wirings 9 and the X-directional wirings 10 to form gaps 5' in the conductive films 4. The applied pulse voltage had the same waveform as shown in FIG. 3A, with a pulse width T1 of 0.1 ms, a pulse interval T2 of 10 ms, and a peak value of 10 V.

After the space between the rear plate 1 and the hood was evacuated, the "activation" process was performed. In this "activation" process, pulses were repeatedly applied between the electrode 2 and 3 through the X-directional wirings 10 and the Y-directional wirings 8 as in the foregoing "forming" process. Tolunitrile was used as the carbon-containing gas and the pressure of the space between the hood and the rear plate 1 was maintained at $1.3\times10^{-4}$ Pa. The applied voltage had the same waveform as shown in FIG. 4A, with a pulse width T1 of 1 ms, a pulse interval T2 of 10 ms, and a peak value of 16 V.

When the device current If was substantially saturated after about 60 minutes, the "activation" process was terminated.

Then, the rear plate 1 having many electron-emitting devices produced through the foregoing steps was bonded to a faceplate having a light-emitting member in a vacuum. Specifically, a supporting frame 14 was fixed to the rear plate 1 and placed in a vacuum sealing apparatus (not shown), together with the faceplate 11 having the light-emitting member 12 and a metal back 13. The bonding areas of the supporting frame 14, to be bonded to the faceplate 11 and the rear plate 1 were provided with indium in advance. Then, the faceplate 11 and the rear plate 1 placed in the sealing apparatus were degassed by baking at 350° C. in a vacuum, with a sufficient distance therebetween.

Then, the rear plate 1 was cooled to a temperature of 180° C., and water ($H_2O$ gas) and hafnium-containing gas were alternately introduced into the sealing apparatus with the substrate temperature (180° C.) maintained. Thus, a hafnium coating film was formed over each electron-emitting device.

For the formation of the hafnium coating film, a sequence of the following Step A and Step B was repeated 50 cycles with the substrate temperature maintained at 180° C.

Step A: $H_2O$ gas was introduced into the sealing apparatus (vacuum chamber) until the pressure was increased to 1000 Pa, and the pressure was maintained for 10 seconds. Subsequently, the sealing apparatus (vacuum chamber) was evacuated to a pressure of about 1 Pa.

Step B: $Hf[N(CH_3)_2]_4$ (tetrakis(dimethylamino)hafnium) gas was introduced into the sealing apparatus (vacuum chamber) until the pressure was increased to 1000 Pa, and the pressure was maintained for 10 seconds. Subsequently, the sealing apparatus (vacuum chamber) was evacuated to a pressure of about 1 Pa.

The faceplate 11 having the metal back 13, to which a barium getter had been deposited in advance, was gradually brought close to the rear plate 1 coated with the hafnium coating film. Thus, the two plates were bonded together, with the indium previously applied onto the supporting frame 14.

Upon the completion of the above process, a vacuum-sealed image display device (display panel) 131 was completed.

The resulting image display device was connected to a driver (not shown), and the characteristics of the electron-emitting devices 8 were evaluated and a test pattern was displayed. As a result, the initial electron emission efficiency was 3% per electron-emitting device 8, and the initial emission current was at least 2 times as high as the emission current required for each pixel. Also, the electron-emitting devices were able to be driven at a lower voltage.

In addition, brighter images were displayed over the entire surface of the image display device. Furthermore, a substantially constant electron emission efficiency was maintained over a long period of time and the absolute value of the emission current does not vary. Thus, the resulting image display device exhibited superior characteristics relative to conventional devices.

While the present invention has been described with reference to exemplary embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-179929 filed Jun. 17, 2004, which is hereby incorporated by reference herein in its entirety, as if fully set forth herein.

What is claimed is:

1. A method for manufacturing a precursor to an electron-emitting device, comprising the steps of:

preparing an electron-emitting member; and alternately exposing the electron-emitting member to an oxygen-containing gas and a metal-containing gas a plurality of times.

2. The method according to claim 1, wherein the metal-containing gas comprises an organic metal.

3. The method according to claim 1, wherein the oxygen-containing gas comprises $O_2$ or $H_2O$.

4. The method according to claim 1, wherein the electron-emitting member contains carbon.

5. The method according to claim 1, wherein electron-emitting member comprises carbon fibers.

6. The method according to claim 1, wherein the oxygen-containing gas has a partial pressure in the range of $1\times10^{-4}$ to $1\times10^{4}$ Pa.

7. The method according to claim 1, wherein the metal containing gas has a partial pressure in the range of 1 to 1000 Pa.

8. The method according to claim 1, wherein the metal-containing gas contains a metal selected from the group consisting of hafnium, titanium, and zirconium.

9. A method for manufacturing an electron source including a plurality of electron-emitting devices, the method comprising the step of producing precursors to the electron-emitting devices each by the method as set forth in claim 1.

10. A method for manufacturing an image display device including an electron source and a light-emitting member, the method comprising the step of producing the electron source by the method as set forth in claim 9.

11. A method for manufacturing a precursor to an electron-emitting device, comprising the steps of:

preparing a first electroconductive film and a second electroconductive film; and alternately exposing at least one of the first electroconductive film and the second electroconductive film to an oxygen-containing gas and a metal-containing gas a plurality of times.

12. The method according to claim 11, wherein the step of preparing the first electroconductive film and the second electroconductive film includes the sub steps of:

forming an electroconductive film on a substrate;

applying a current to the electroconductive film to form a gap in the electroconductive film; and applying a current to the electroconductive film having the gap in an atmosphere containing a carbon-containing gas, wherein the first and second electroconductive films are sub-parts of the electroconductive film, separated by the gap.

13. The method according to claim 11, wherein the metal-containing gas comprises an organic metal.

14. The method according to claim 11, wherein the oxygen-containing gas comprises $O_2$ or $H_2O$.

15. The method according to claim 11, wherein the oxygen-containing gas has a partial pressure in the range of $1\times10^{-4}$ to $1\times10^{4}$ Pa.

16. The method according to claim 11, wherein the metal-containing gas has a partial pressure in the range of 1 to 1000 Pa.

17. The method according to claim 11, wherein the metal-containing gas contains a metal selected from the group consisting of hafnium, titanium, and zirconium.

18. A method for manufacturing an electron source including a plurality of electron-emitting devices, the method comprising the step of producing precursors to the electron-emitting devices each by the method as set forth in claim 11.

19. A method for manufacturing an image display device including an electron source and a light-emitting member, the method comprising the step of producing the electron source as set forth in claim 18.

* * * * *